US006739737B2

(12) United States Patent
Yu

(10) Patent No.: US 6,739,737 B2
(45) Date of Patent: May 25, 2004

(54) LAMP BODY FOR A FLUORESCENT COMPACT SPOT AND FLOOD LIGHT SOURCE

(76) Inventor: William Yu, 25121 Vista Ridge Rd., Laytonsville, MD (US) 20882

( * ) Notice: Subject to any disclaimer, the term of this patent is extended or adjusted under 35 U.S.C. 154(b) by 22 days.

(21) Appl. No.: 10/175,807

(22) Filed: Jun. 21, 2002

(65) Prior Publication Data

US 2003/0001504 A1 Jan. 2, 2003

(30) Foreign Application Priority Data

Jun. 27, 2001 (CN) ..... 01 2 46172 U

(51) Int. Cl.[7] ..... F21V 7/00

(52) U.S. Cl. ..... 362/300; 362/246; 362/260; 362/297; 313/634; 313/116

(58) Field of Search ..... 362/297, 300, 362/351, 216, 244, 245, 246, 247, 260, 222, 223; 313/113, 634, 318.11, 110, 112, 116

(56) References Cited

U.S. PATENT DOCUMENTS 4,270,071 A * 5/1981 Morton ..... 315/62
4,337,414 A * 6/1982 Young ..... 315/56
4,498,125 A * 2/1985 Schumaker ..... 362/216
4,520,436 A * 5/1985 McNair et al. ..... 362/366
4,541,038 A * 9/1985 Van Noord ..... 362/352
4,644,224 A * 2/1987 Saita et al. ..... 313/634
4,750,096 A * 6/1988 Lim ..... 362/218
4,761,721 A 8/1988 Willing ..... 362/348
4,878,159 A * 10/1989 Blaisdell et al. ..... 362/222
5,272,408 A * 12/1993 Levin et al. ..... 313/113
5,363,295 A * 11/1994 DeKleine et al. ..... 362/346
RE36,414 E * 11/1999 Tickner ..... 362/235
6,168,299 B1 * 1/2001 Yan ..... 362/365
6,318,880 B1 * 11/2001 Siminovitch et al. ..... 362/225
6,390,646 B1 * 5/2002 Yan ..... 362/260
6,398,384 B2 * 6/2002 Siminovitch et al. ..... 362/225
6,404,123 B1 * 6/2002 Cooch ..... 313/493
6,437,502 B1 * 8/2002 Nishio et al. ..... 313/493

* cited by examiner

*Primary Examiner*—John Anthony Ward
(74) *Attorney, Agent, or Firm*—Dowell & Dowell, P.C.

(57) ABSTRACT

A lamp body of the compact spot and flood light type suitable for use with a compact fluorescent light source, wherein the lamp body includes a lamp head, a lampshade for reflecting the light emitted from the light source, and an adapter connected to the lamp head, wherein the lampshade is formed by the integration of at least two coaxial conical surfaces with different vertex angles.

13 Claims, 3 Drawing Sheets

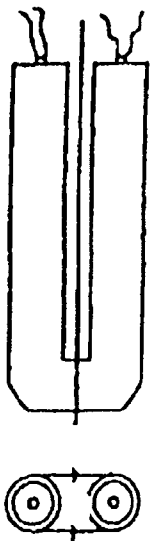
FIG. 2A
FIG. 2B
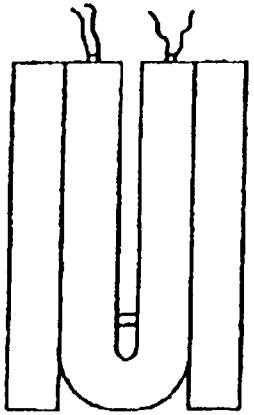
FIG. 2C
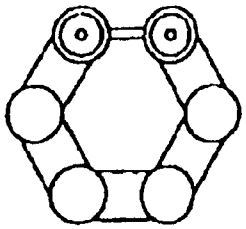
FIG. 2D
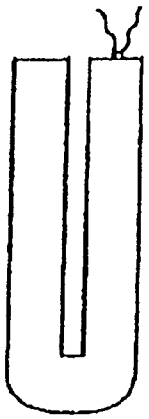
FIG. 2E
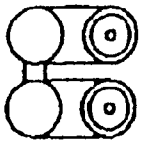
FIG. 2F
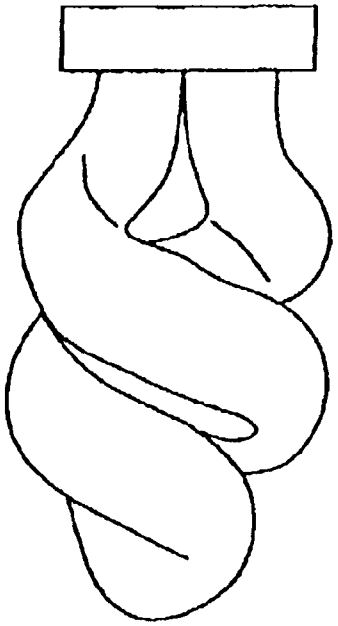
FIG. 2G

LAMP BODY FOR A FLUORESCENT COMPACT SPOT AND FLOOD LIGHT SOURCE

BACKGROUND OF THE INVENTION

1. Field of the Invention

The invention relates to a lamp body or reflector for a power-saving lamp, and more particularly, to a lamp body for a compact fluorescent spot and flood light source with improved lighting efficiency.

2. Brief Description of the Related Art

Today, a wide range of different compact fluorescent spot and flood lights (CSFLs), such as the 9W2U (9-watt, twin-U-shaped tube), the 13W2U and the 13WS (13-watt spiral tube), are available in the market to meet the needs for energy-saving and higher lighting efficiency. They provide better performances of energy savings and luminous intensity than those of conventional incandescent lamps to some extent, but they are still not fully desirable in terms of the luminous intensity. Furthermore, a relatively complex technology is needed for forming an accurate parabolic or arcuate surface die assembly with many processes required to make their lampshade with a parabolic or arcuate surface. Typically, these energy-saving CSFLS comprise a tube and a lamp body including a lamp head, a lampshade and a tube adapter.

To obtain a further increase in brightness, some improved energy-saving CSFLS have been proposed. For example, a reflecting lampshade suitable for compact fluorescent light sources is disclosed in U.S. Pat. No. 4,761,721. The lampshade, as shown in FIG. 3, is formed primarily by an upper conical surface section 8 and lower arcuate surface section 9 with vertical troughs along their inner surfaces, and a reflecting surface towards an axis of the lampshade is formed on the arcuate surface section 9 in parallel to the bottom side of the trough. This reflecting lampshade can increase the intensity beneath it to some extent. However, in its manufacturing, it is very complicated to intersect a conical surface with an arcuate surface in a determined angle for integration. The processes to make such an arcuate surface is difficult. The concave troughs must be engraved on the inner sides of the conical surface section 8 and the arcuate surface section 9. Thus, it is obvious that the reflecting lampshade disclosed the patent is complicated in the technology for implementation, thereby the cost for manufacturing is high.

The object of the invention is to provide a lamp body for a compact fluorescent spot and flood light or tube(s) source with improved lighting efficiency. The lamp body of the invention can make full use of a light source to obtain further increase of luminous intensity beneath the lamp, and the technology for manufacture is simple.

SUMMARY OF THE INVENTION

The invention provides a lamp body or reflector for a compact fluorescent spot and flood light source, wherein the lamp body includes a lamp head, a lampshade for reflecting the light emitted from the light source, and an adapter with one end connected to the lamp head and another end adapted to said compact fluorescent tube(s) light source, wherein the lampshade is formed by the integration of at least two coaxial conical surfaces with different vertex angels.

Preferably, the lampshade is formed by the integration of two coaxial conical surfaces with 90° and 60° vertex angles, respectively. The bar type or compact fluorescent tube(s) light source is preferably a twin-spiral tube. There may be a lower surface on the bottom edge of the lampshade to function as a guard for the light source and make the light therefrom softer. A reflecting film can be coated on the inner surface of the lampshade to increase the reflection efficiency. The lamp body further includes a ballast arranged in the adapter.

As described above, when a lamp body having a lampshade formed by the integration of two coaxial conical surfaces with different vertex angles is used with a compact fluorescent tube(s) light source, the light from the source can be fully used such that the luminous intensity beneath the lampshade increases to a level noticeably higher than that obtained by a CSFL with a lamp body using conventional lampshade with parabolic or arcuate surface of the prior art (e.g. the lamp body in R, BR, ER and PAR serials). The lampshade of the lamp body according to the invention is an integration of two or more coaxial conical surfaces, so the manufacturing technology used for it is simpler than that for the usual parabolic or arcuate type lampshade of the lamp body, and thus the production cost for the lamp body is reduced. Accordingly, the lamp body of energy-saving CSFL in accordance with the invention not only increases the lighting efficiency, but also is of great value, in enhancing production, such that it is a good prospect for development.

BRIEF DESCRIPTION OF DRAWINGS

The above, and other objects, and novel features of the invention will become apparent from the detailed description set forth below in conjunction with the accompanying drawings, in which:

FIG. 2A is a front elevated view of a conventional U-shaped compact fluorescent tube light source which may be used with the present invention;

FIG. 2B is a top plane view of the tube of FIG. 2A;

FIG. 2C is a front elevational view of another conventional compact fluorescent light source including a plurality of U-shaped tube sections which may be used with the present invention;

FIG. 2D is a top plan view of the tube source of FIG. 2C;

FIG. 2E is a front elevational view of a further conventional compact fluorescent light source including a pair of U-shaped tube sections which may be used with the present invention;

FIG. 2F is a top plan view of the tube source of FIG. 2E;

FIG. 2G is a front elevational view of a twin-spiral compact fluorescent tube light source which may be used with the present invention.

DESCRIPTION OF THE PREFERRED EMBODIMENT

Figure 1:
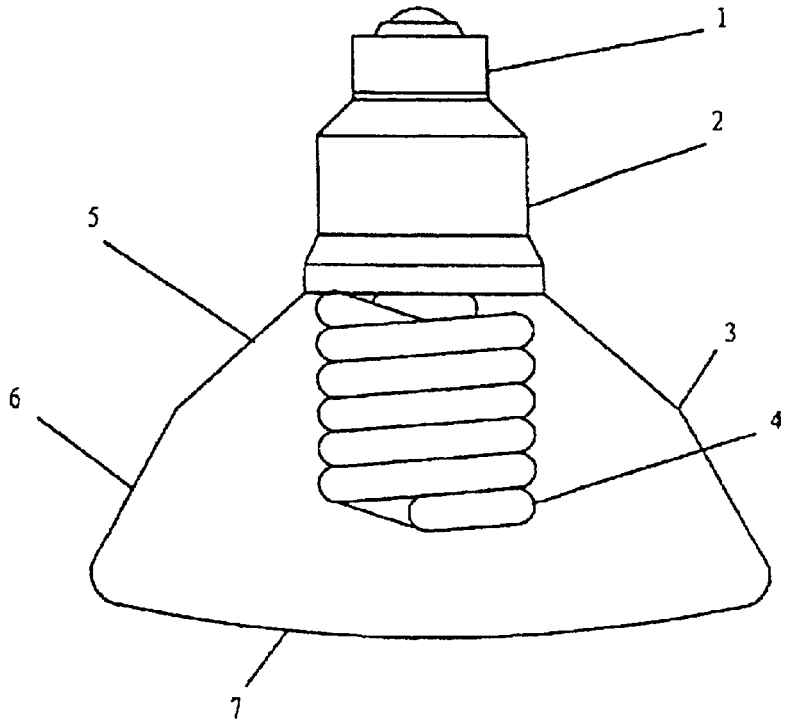
FIG. 1 is a schematic drawing showing the lamp body or reflector of CSFL in accordance with the invention used with a twin-spiral compact fluorescent light source tube.
Figure 3:
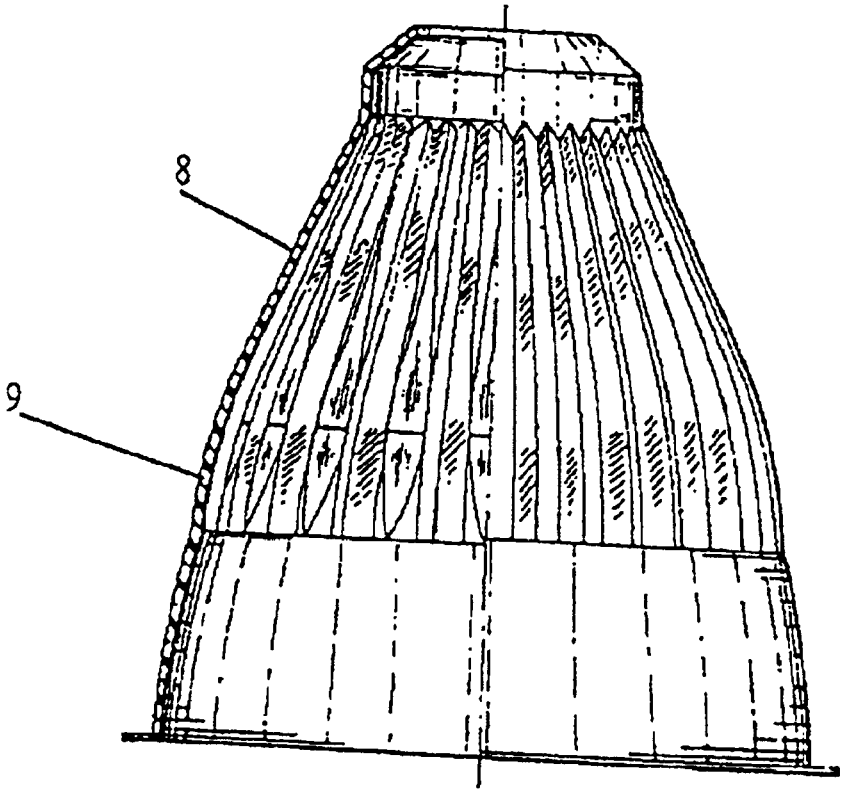
FIG. 3 (PRIOR ART)
FIG. 3 is a perspective view of the reflecting lampshade of the prior art.

FIG. 1 is a schematic drawing showing the lamp body or reflector of CSFL of the invention used with a twin-spiral compact fluorescent light source tube 4. As shown in FIG. 1, the lamp body includes an upper lamphead section 1, a lower lampshade section 3, and an adapter 2 with one end connected to the lamp head section 1 and another end connected to the twin-spiral tube 4. A ballast (not shown) is arranged within the adapter 2. The lamp body and the twin-spiral tube 4 forms a complete CSFL. Of course, the lamp body may be a separate product, or may be incorporated with the twin-spiral tube 4 or other tube to form a complete light product. The twin-spiral tube 4 may be connected to the adapter 2 in a permanent manner, or in a interchangeable manner, to change the tube 4 or adapter 2 independently when they are damaged. In one embodiment, the ballast is separated from the lamp body, rather than included within the adapter as described above, to form an independent element of the CSFL. In this case, if the ballast fails, there is no need to change the whole adapter or lamp body, only the failed ballast.

Referring to FIG. 1, in the lamp body, the lampshade 3 used for reflecting the light from the source is formed by the integration of the coaxial conical surface sections 5 and 6 having vortex angles of 90° and 60°, respectively, with an angle of 165° between them in the space. In FIG. 1, the twin-spiral tube 4 is used with the lamp body, and connected to lamphead section 1 through the adapter 2 so as to connect to the ballast within the adapter 2 for igniting. Furthermore, there is a transparent or frosted arc-shaped lower surface 7 on the bottom edge of lampshade 3. The lower surface provides an artistical decoration and a guard for the twin-spiral tube 4 and provides soft lighting therefrom. However, the luminous intensity beneath the CSFL will be somewhat reduced by the lower surface 7.

Although the twin-spiral tube 4 is used with the CSFL as described, other types of compact fluorescent tubes, such as single U-shaped tube, see FIGS. 2A and 2B, twin U-shaped tube, see FIGS. 2E and 2F, triple U-shaped tube, see FIGS. 2C and 2D can be used for the same purpose. In these conventional types of tubes, the fluorescent tube is wound or curved into shapes, such that a larger light emitting area can be obtained with a smaller volume. The tubes shown in FIGS. 2A–2G are all in a substantially bar shape. It means that the lamp body of the invention is suitable for similar compact bar shape sources.

In the invention, the twin-spiral tube 4 used as a light emitting source, as described above, is a bulk source having an approximate bar shape emitting a volume of light large and longer than that of a spot source, such as that from an incandescent lamp. Moreover, in the lamp body according to invention, the shape of lampshade section 3 is based on the geometric light-distribution feature of the bar or other compact light source (i.e. the twin-spiral tube 4) such that light emitting from twin-spiral tube 4 can be reflected well by the lampshade section 3. Consequently, using the lampshade section 3 which is based on the light distribution feature of the light source and formed by the integration of two coaxial conical surfaces with different vertex angles, the lampshade can be adapted to the shape of the light emitting source so that the light emitted from the twin-spiral tube 4 is directionally re-distributed in a more effective manner, and thus the lighting efficiency is increased.

A comparison and analysis was made of the lights from several compact fluorescent tube light sources as they were used with the conventional lamp body, lampshade section with parabolic surface, and the lamp body of the invention which includes a lampshade section formed by the integration of two coaxial conical surface with different vertex angles. By using the integrating sphere method, the luminance fluxes of the lamps without lampshade are measured first, and then the luminance fluxes of the complete CSFL with lampshade are measured, respectively, to calculate the flux efficiency. In addition, the luminous intensities beneath the CSFL with lampshade are measured by using a luminometer. As a result, the data of bare lamp luminance flux, device luminance flux, flux efficiency and luminous intensity beneath the lamp body from 13WS tube, 13W3U tube and 9WS tube in which the lamp body of the invention and the conventional lamp body were used, respectively, are shown in Tables 1, 2 and 3.

TABLE 1

| Lamp body | Bare lamp flux 1 (m) | Device flux 1 (m) | Efficiency | Intensity beneath (cd) |
|---|---|---|---|---|
| (used with 13WS tube Conventional) | 780 | 538 | 69% | 147 |
| The invention | 780 | 686 | 88% | 438 |

TABLE 2

| Lamp body | Bare lamp flux 1 (m) | Device flux 1 (m) | Efficiency | Intensity beneath (cd) |
|---|---|---|---|---|
| (used with 13W3u cfl tube Conventional) | 780 | 484 | 62% | 264 |
| The invention | 780 | 655 | 84% | 387 |

TABLE 3

| Lamp body | Bare lamp flux 1 (m) | Device flux 1 (m) | Efficiency | Intensity beneath (cd) |
|---|---|---|---|---|
| (used with 9WS cfl tube Conventional) | 539 | 237 | 44% | 249 |
| The invention | 539 | 350 | 65% | 372 |

As shown in Tables 1, 2 and 3, the luminous intensity beneath the lamp body increases noticeably when the lamp body of the invention is used. In these tables, it is obvious that the lamp body in accordance with the invention provides a luminous intensity and efficiency higher than those in the conventional lamp body. Therefore, it is evident from the foregoing data that the luminous intensity and the flux efficiency are both improved considerably when the lamp body of the invention is used.

For manufacturing, the lamp body in accordance with the invention can be made of glass, metal, plastic, etc. On the other hand, as described above, many processes are needed to form a die assembly with accurate and smooth curved surface, since the reflecting lampshade of CSFL in the prior art has a parabolic or arc surface in general. However, in the invention, the lampshade section 3 of the lamp body is formed by two coaxial conical surfaces 5 and 6, and the inner side thereof is a conical surface, rather than a parabolic or arc surface. Thus, in the lamp body according to the invention, the technology for manufacture is simpler than that of prior art, and the cost of production is reduced.

Moreover, for further increasing the luminance intensity beneath the lamp body and the flux efficiency of the CSFL using the lamp body in accordance with the invention, a reflecting layer can by coated on the inner surface of the lampshade of the lamp body to improve the reflective capability of the lampshade. The reflecting layer can be formed by using material having high reflection ratio such as Al, Ag.

As described above, the lampshade 3 in the embodiment according to the invention is formed by the integration of two coaxial conical surfaces 5 and 6 with different vertex angles. This structure is simple and easy for manufacturing with noticeable results achieved. Naturally, the lampshade 3 of the lamp body not only can be formed by two conical surfaces, but also can be formed by a plurality of coaxial conical surfaces with different vertex angles in an integrated manner in accordance with the invention.

It should be appreciated that all the descriptions and illustrations given hereinbefore are exemplary preferred embodiments of the invention only, and many modifications and variations thereof will be apparent to those skilled in the art. Thus, the invention is not intended to be limited by the embodiments disclosed, and the scope of the invention is only limited by the appended claims.

I claim:

1. A lamp body of a compact spot and flood light type for use with a compact fluorescent light source including a lamp head, a lampshade having an inner surface for reflecting light emitted from the light source, an adapter having one end connected to said lamp head and another end adapted to connect to the light source, and said inner surface of said lampshade being defined by at least two coaxial conical surface sections having different vertex angles.

2. The lamp body according to claim 1, wherein said at least two coaxial conical surfaces sections have 90° and 60° vertex angles, respectively.

3. The lamp body of claim 2, including a light source in the form of a twin-spiral tube.

4. The lamp body claim 3, including a lower surface adjacent a bottom edge of said lampshade which is adapted to function as a guard for said light source.

5. The lamp body of claim 2, including a reflective material on said inner surface of said lampshade to increase reflection efficiency.

6. The lamp body of claim 2, including a ballast arranged within said adapter.

7. The lamp body of claim 1, including a reflective material on said inner surface of said lampshade to increase reflection efficiency.

8. The lamp body of claim 1, including a ballast arranged within said adapter.

9. A compact spot and flood light comprising a lamp body in which is mounted a compact fluorescent light source, said lamp body including a lamp head and a lampshade having an inner surface for reflecting light emitted from said light source, said lamp body further including an adapter having one end connected to said lamp head and another end adapted to connect to said light source, and said inner surface of said lampshade being defined by at least two coaxial conical surface sections having different vertex angles.

10. The compact spot and flood light according to claim 9, wherein said at least two coaxial conical surface sections have 90° and 60° vertex angles, respectively.

11. The compact spot and flood light of claim 9, including a lower surface adjacent a bottom edge of said lampshade which is adapted to function as a guard for said light source.

12. The compact spot and flood light of claim 11, including a reflective material on said inner surface of said lampshade to increase reflection efficiency.

13. The compact spot and flood light of claim 11, wherein said lamp body further includes a ballast arranged within said adapter.

* * * * *